US005309655A

United States Patent [19]

Mitchell

[11] Patent Number: 5,309,655

[45] Date of Patent: May 10, 1994

[54] COMPACT RECORD OF HUMAN-READABLE DATA

[76] Inventor: Maxwell R. Mitchell, 3616 Morningside La., Bowie, Md. 20715

[21] Appl. No.: 804,390

[22] Filed: Dec. 10, 1991

Related U.S. Application Data

[63] Continuation-in-part of Ser. No. 715,389, Jun. 14, 1991, abandoned.

[51] Int. Cl.[5] ..... G09F 3/00

[52] U.S. Cl. ..... 40/299; 40/371

[58] Field of Search ..... 40/299, 625, 371, 661, 40/642; 283/76, 77, 111, 112; 235/487, 488

[56] References Cited

U.S. PATENT DOCUMENTS

| | | | |
|---|---|---|---|
| 2,461,536 | 2/1949 | Farkas | 40/661 X |
| 3,117,608 | 1/1964 | Goss et al. | 283/76 X |
| 3,178,842 | 4/1965 | Zimmerman | 40/642 |
| 3,180,042 | 4/1965 | Destal | 40/642 |
| 3,607,524 | 9/1971 | Kuhns | 283/77 X |
| 3,755,935 | 9/1973 | Annenberg | 283/77 X |
| 3,758,970 | 9/1973 | Annenberg | 283/77 X |
| 4,101,701 | 7/1978 | Gordon | 283/77 X |
| 4,197,665 | 4/1980 | Siiter | 283/76 X |
| 4,239,261 | 12/1980 | Richardson | 40/299 X |
| 4,259,391 | 3/1981 | Brecht | 283/76 X |
| 4,318,554 | 3/1982 | Anderson et al. | 283/77 X |
| 4,435,912 | 3/1984 | Adrian et al. | 283/76 X |
| 4,648,189 | 3/1987 | Michel | 40/625 X |
| 4,680,459 | 7/1987 | Drexler | 235/487 |
| 4,917,292 | 4/1990 | Drexler | 235/488 |

*Primary Examiner*—Kenneth J. Dorner
*Assistant Examiner*—Milton Nelson, Jr.
*Attorney, Agent, or Firm*—Dressler, Goldsmith, Shore & Milnamow, Ltd.

[57] ABSTRACT

A compact record of plural pages of human-readable data from a manual concerning a piece of equipment comprises two opaque sheets in back-to-back relation to each other, each reproducing pages of such data in a reduced size that is readable by a human under normal room light if magnified about ten times, as by a pocket magnifier. The opaque sheets and a marker bearing indicia identifying the piece of equipment are laminated between two substantially transparent layers. The compact record is bound into a booklet, as by a ring, with at least one record of similar construction.

8 Claims, 1 Drawing Sheet

COMPACT RECORD OF HUMAN-READABLE DATA

CROSS-REFERENCE TO RELATED APPLICATION

This application is a continuation-in-part of U.S. patent application Ser. No. 07/715,389 filed Jun. 14, 1991 and now abandoned.

TECHNICAL FIELD OF THE INVENTION

This invention pertains to a record of human-readable data, such as plural pages of human-readable data from a manual for a piece of equipment. The record comprises an opaque sheet bearing a photographic record reproducing human-readable data in a greatly reduced size, preferably a photographic positive reproducing plural pages of human-readable data in a greatly reduced size.

BACKGROUND OF THE INVENTION

Frequently, users of computer equipment and other equipment involving complex technology need to keep bulky records including service manuals, circuit diagrams, and service histories for ready access by service technicians who would face undue difficulties if such records could not be readily retrieved. Also, users managing their inventories of such equipment need to mark such equipment with bar codes representing inventory numbers, with warranty information, and with other data. These needs are pronounced with governmental agencies, large businesses, and other users having substantial inventories of such equipment.

Microfilm and microfiche have been used to reduce service manuals and other data to compact forms. However, microfilm and microfiche share a serious disadvantage, which is that neither can be easily read by a human under normal room light without special projectors or other apparatus. Where microfiche has rigid cell sizes, it may be necessary to cut up drawings and other pages of nonstandard sizes before recording them on microfiche. Heretofore, there has been no effective way to reproduce plural pages of human-readable data in a compact form that can be easily read by a human under normal room light with a simple magnifier, such as a pocket magnifier.

SUMMARY OF THE INVENTION

Addressing the needs noted above, this invention provides a compact record of human-readable data, such as plural pages of human-readable data from a manual for a piece of equipment. The record comprises an opaque sheet bearing a photographic print reproducing such pages in a reduced size that is readable by a human under normal room light if the photographic print is magnified at least several times with a simple magnifier, such as a pocket magnifier, and that is not readable by a human under normal room light unless the photographic print is magnified at least several times. It is preferred that the photographic print reproduces such pages in a reduced size that cannot be easily read by a human under normal room light unless the photographic print is magnified about ten times. It is preferred, moreover, that the photographic print is a positive print.

In a preferred form, in which the photographic print reproduces plural pages of human-readable data concerning a piece of equipment, such a record comprises a marker bearing indicia identifying the piece of equipment. The opaque sheet and the marker are laminated between layers of material protecting the opaque sheet and the marker. The layers include a substantially transparent layer overlying the photographic print and the marker indicia.

In an enhanced form, such a record comprises a pair of opaque sheets in back-to-back relation to each other, each bearing a photographic print reproducing plural pages of human-readable data in such a reduced size. The opaque sheets may be laminated between substantially transparent sheets of material protecting the opaque sheets.

Such a record may be bound with at least one record comprising a similar sheet bearing a similar print reproducing plural pages of human-readable data in a similar size. The bound records form a booklet. Each opaque sheet of each bound record may bear a similar print reproducing plural pages of human-readable data in a similar size.

Herein, all references to human-readable data are intended to refer to text, drawings, handwritten data, and other types of human-readable data, in any medium that can be photographically reproduced. Herein, all references to a photographic print are intended to refer to a reproduction of an image on a sensitized surface by the action of light or other radiant energy. These and other objects, features, and advantages of this invention are evident from the following description of a preferred embodiment of this invention with reference to the accompanying drawings.

DETAILED DESCRIPTION OF PREFERRED EMBODIMENT

Figure 1:
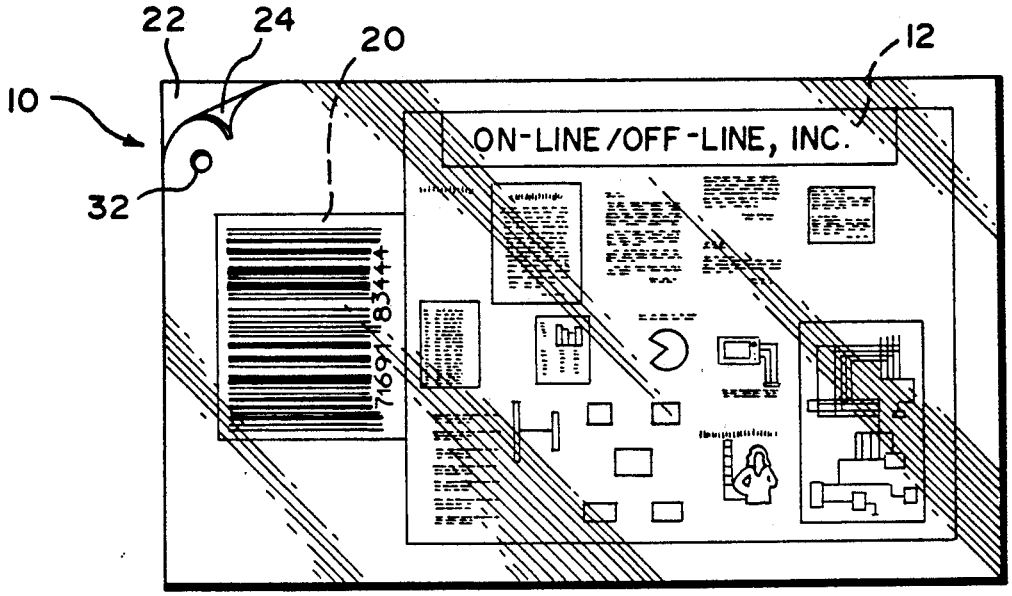
FIG. 1 is a plan view of a compact record embodying this invention. One corner of one of two laminating layers is shown as peeled back.

As shown in FIG. 1, a compact record 10 of plural pages of human-readable data from a service manual concerning a piece of equipment (not shown) constitutes a preferred embodiment of this invention.

The compact record 10 comprises two opaque sheets 12 of photographic paper in back-to-back relation to each other, each bearing a positive, photographic print reproducing plural pages of human-readable data in a reduced size that is readable by a human under normal room light if the photographic print is magnified at least several times, as by a pocket magnifier M having a single lens L, and that is not readable by a human under normal room light unless the photographic print is magnified at least several times. It is preferred that the photographic print reproduces such pages in a reduced size that cannot be easily read by a human under normal room light unless the photographic print is magnified about ten times.

The compact record 10 comprises a paper marker 20 bearing bar codes and other indicia identifying the piece of equipment. The opaque sheets 12 and the paper marker 20 are laminated between two layers 22, 24, of substantially transparent, polymeric material overlying and protecting the photographic prints and the marker indicia. A vinyl material, preferably 7-gauge, may be advantageously used for the substantially transparent layers 22, 24.

Figure 2:
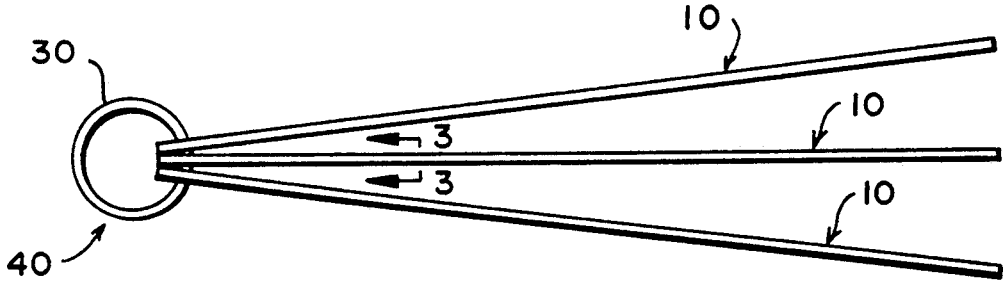
FIG. 2 is an edge view of a booklet wherein the compact record of FIG. 1 is bound with two other records of similar construction. The booklet is shown as bound by a ring passing through holes in the bound records.
Figure 3:
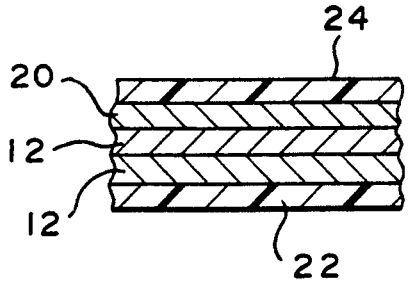
FIG. 3, on a greatly enlarged scale, is a fragmentary, sectional view of the compact record of FIG. 1, as taken along line 3—3 of FIG. 2, in a direction indicated by arrows.
Figure 4:
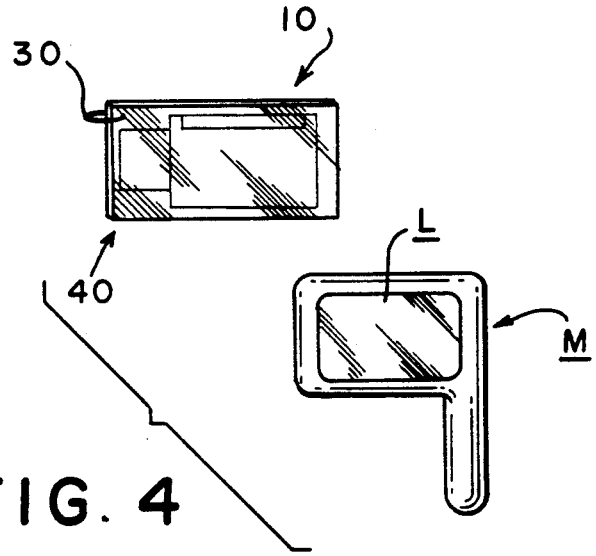
FIG. 4, on a greatly reduced scale, is a plan view of the booklet and of a pocket magnifier used to read human-readable data reproduced on each of the bound records.

As shown in FIG. 2, three such records 10 of similar construction are bound into a booklet 40 by a wire ring 30 passing through a hole 32 in each of the bound records 10. Other binding means (not shown) may be alternatively used, such as a spiral wire passing through holes along one edge of each of the bound records 10. In the booklet 40, each bound record 10 comprises two of the opaque sheets 12 in back-to-back relation to each other. Moreover, each opaque sheet 12 bears a similar print reproducing plural pages of human-readable data in a similar size. Being compact, the booklet 40 can be conveniently stored within or nearby the piece of equipment or attached to the piece of equipment by any suitable means (not shown) for ready access by a service technician. A Betamag TM pocket magnifier is useful to enable each photographic print to be easily read by a human under normal room light.

When each photographic print is made, the pages to be so reproduced are mounted on a white or neutral wall, panel, or backdrop and are photographed at f22 on Kodak TM Tech Pan TM No. 4415 film, via a Horsemanv or Zeiss TM 150 mm lens in any suitable camera using a flash unit with a bare bulb (no reflectors) close to the lens. A negative image is developed on such film with Kodak TM Dektol TM developer, in an undiluted condition, at approximately 68° F. The negative image is fixed with Kodak TM fixer, in an undiluted condition, at approximately 68° F. A positive image is printed on Agfa TM No. 5 double weight, fiber based, photographic paper with the same developer, as diluted 1:2 with water, at approximately 68° F. The positive image is fixed with the same fixer, in an undiluted condition, at approximately 68° F. The positive image is treated with Permawash TM archiving solution.

As many as eight letter-sized (8"×11") pages of human-readable data may be so photographed on one frame of 35 mm film. As many as 25 letter-sized pages of human-readable date may be so photographed on 120 film. As many as 60 pages of human-readable data may be so photographed on 4"×5" film.

Various modifications may be made in the preferred embodiment described above without departing from the scope and spirit of this invention.

I claim:

1. A compact record of human-readable data concerning a piece of equipment, the record comprising an opaque sheet bearing a positive, photographic print on photographic paper, said print reproducing human-readable data concerning the piece of equipment in a reduce size that is readable by a human if the photographic print is magnified at least several times, as by a pocket magnifier, and that is not readable by a human unless the photographic print is magnified at least several times, the record comprising a marker bearing indicia identifying the piece of equipment, wherein the opaque sheet and the marker are laminated between layers of material protecting the opaque sheet and the marker, said layers including a substantially transparent layer overlying the photographic print and the marker indicia.

2. The record of claim 1 wherein the photographic print reproduces human-readable data concerning the piece of equipment in a reduced size that cannot be easily read by a human unless the photographic print is magnified about ten times.

3. A compact record of human-readable data, the record comprising a pair of opaque sheets in back-to-back relation to each other, each bearing a positive, photographic print on photographic paper, said print reproducing human-readable data in a reduced size that is readable by a human if the photographic print is magnified at least several times, as by a pocket magnifier, and that is not readable by a human unless the photographic print is magnified at least several times.

4. The record of claim 3 bound with at least one record comprising a similar sheet bearing a similar print reproducing human-readable data in a similar size, the bound records forming a booklet.

5. The record of claim 4 wherein each bound record comprises a pair of similar opaque sheets in back-to-back relation to each other, wherein each opaque sheet of each bound record bears a similar print reproducing human-readable data in a similar size.

6. A compact record of human-readable data, the record comprising a pair of opaque sheets in back-to-back relation to each other, each bearing a positive, photographic print on photographic paper, said print reproducing human-readable data in a reduced size that is readable by a human if the photographic print is magnified at least several times, as by a pocket magnifier, and that is not readable by a human unless the photographic print is magnified at least several times, wherein the opaque sheets are laminated between substantially transparent layers of material protecting the opaque sheets.

7. The record of claim 6 bound with at least one record comprising a similar sheet bearing a similar print reproducing human-readable data in a similar size, the bound records forming a booklet.

8. The record of claim 7 wherein each bound record comprises a pair of similar opaque sheets in back-to-back relation to each other, wherein each opaque sheet of each bound record bears a similar print reproducing human-readable data in a similar size.

* * * * *